United States Patent [19]

Benson et al.

[11] Patent Number: 5,014,608

[45] Date of Patent: May 14, 1991

[54] CLEAN ROOM AIR SYSTEM

[75] Inventors: David E. Benson, Aloha; Michael T. Post, Lake Oswego, both of Oreg.

[73] Assignee: Brod & McClung - Pace Co., Portland, Oreg.

[21] Appl. No.: 569,234

[22] Filed: Aug. 17, 1990

Related U.S. Application Data

[63] Continuation of Ser. No. 344,273, Apr. 27, 1989, abandoned.

[51] Int. Cl.[5] ..... F24F 7/10

[52] U.S. Cl. ..... 98/33.1; 55/467; 55/484

[58] Field of Search ..... 98/31.5, 31.6, 33.1, 98/34.5, 34.6, 36, 40.11, 41.3, 115.3, 115.1; 55/382.2, 484, 467

[56] References Cited

U.S. PATENT DOCUMENTS

| | | | |
|---|---|---|---|
| 3,308,741 | 3/1967 | Chambers | 98/40.11 |
| 3,465,666 | 9/1969 | Knab | 98/40.11 X |
| 3,518,814 | 7/1970 | Maynard | 98/115.1 X |
| 3,986,850 | 10/1976 | Wilcox | 98/40.11 X |
| 4,253,796 | 3/1981 | Phillipps et al. | 415/157 |
| 4,666,477 | 5/1987 | Lough | 98/40.11 X |

FOREIGN PATENT DOCUMENTS

| | | | |
|---|---|---|---|
| 764095 | 12/1956 | United Kingdom | 98/40.11 |

*Primary Examiner*—Harold Joyce

*Attorney, Agent, or Firm*—Klarquist, Sparkman, Campbell, Leigh & Whinston

[57] ABSTRACT

A clean room is supplied with air at a controllable velocity from a blower with a variable damper mechanism. The ceiling of the clean room is comprised of a plurality of panels of particulate filter material. Associated with at least some of said panels are air dampers comprised of first and second adjacent perforated plates. The first plate is fixed and the second plate is mounted for translational movement relative to the first. By moving the second plate relative to the first, the perforations therein are selectably opened or occluded, permitting the air passing through each panel to be regulated. Air flow through the room as a whole is controlled by the variable air flow feature of the blower.

5 Claims, 5 Drawing Sheets

CLEAN ROOM AIR SYSTEM

This application is a continuation of application Ser. No. 07/344,273, filed on Apr. 27, 1989, now abandoned.

FIELD OF THE INVENTION

The present invention relates to air handling equipment, and more particularly to a method and apparatus for controlling the airflow in a clean room.

BACKGROUND AND SUMMARY OF THE INVENTION

Clean rooms are increasingly used in industrial facilities for fabrication of precision electrical and mechanical components. Such rooms are typically pressurized so that contaminants, such as dust or the like, cannot enter when a door thereto is opened. The source of the pressurized air is usually a centrifugal fan mounted on the roof of the building that is operated in conjunction with a highly efficient particulate air filter.

In such applications, it is important that the air be moved at a controlled, low velocity. If the air is moved at a high velocity, it may stir up dust and other debris from within the room. Unfortunately, the air velocity through any given point in the ceiling is a strong function of that point's distance from the outlet of the fan. Further, the air velocity requirements may change with environmental changes or the use to which the room is put. A further requirement is that the air handling equipment should be quiet.

The prior art, while recognizing certain of these constraints, nonetheless has not provided a satisfactory air handling system for such clean room applications. It is an object of the present invention to provide such a satisfactory air handling system.

According to one embodiment of the present invention, a clean room is supplied with air at a controllable velocity from a blower with a variable damper mechanism. The ceiling of the room into which this air is to be routed is comprised of a plurality of panels of particulate filter material. Associated with at least some of said panels are air dampers comprised of first and second adjacent perforated plates. The first plate is fixed and the second plate is mounted for translational movement relative to the first. By moving the second plate relative to the first, the perforations therein are selectably opened or occluded, permitting the air passing through each panel to be regulated. Air flow through the room as a whole is controlled by the variable air flow feature of the blower.

The foregoing and additional objects, features and advantages of the present invention will be more readily apparent from the following detailed description, which proceeds with reference to the accompanying drawings.

DETAILED DESCRIPTION

To provide a comprehensive disclosure without unduly lengthening this specification, applicants incorporate by reference the specification of copending allowed U.S. application Ser. No. 06/874,801 (assigned to the present assignee) and U.S. Pat. Nos. 4,666,477, 4,560,395, 4,135,850, 3,158,457, 3,638,404, 4,693,175 and 4,808,068, which provide background material relevant to the present invention.

Figure 1:
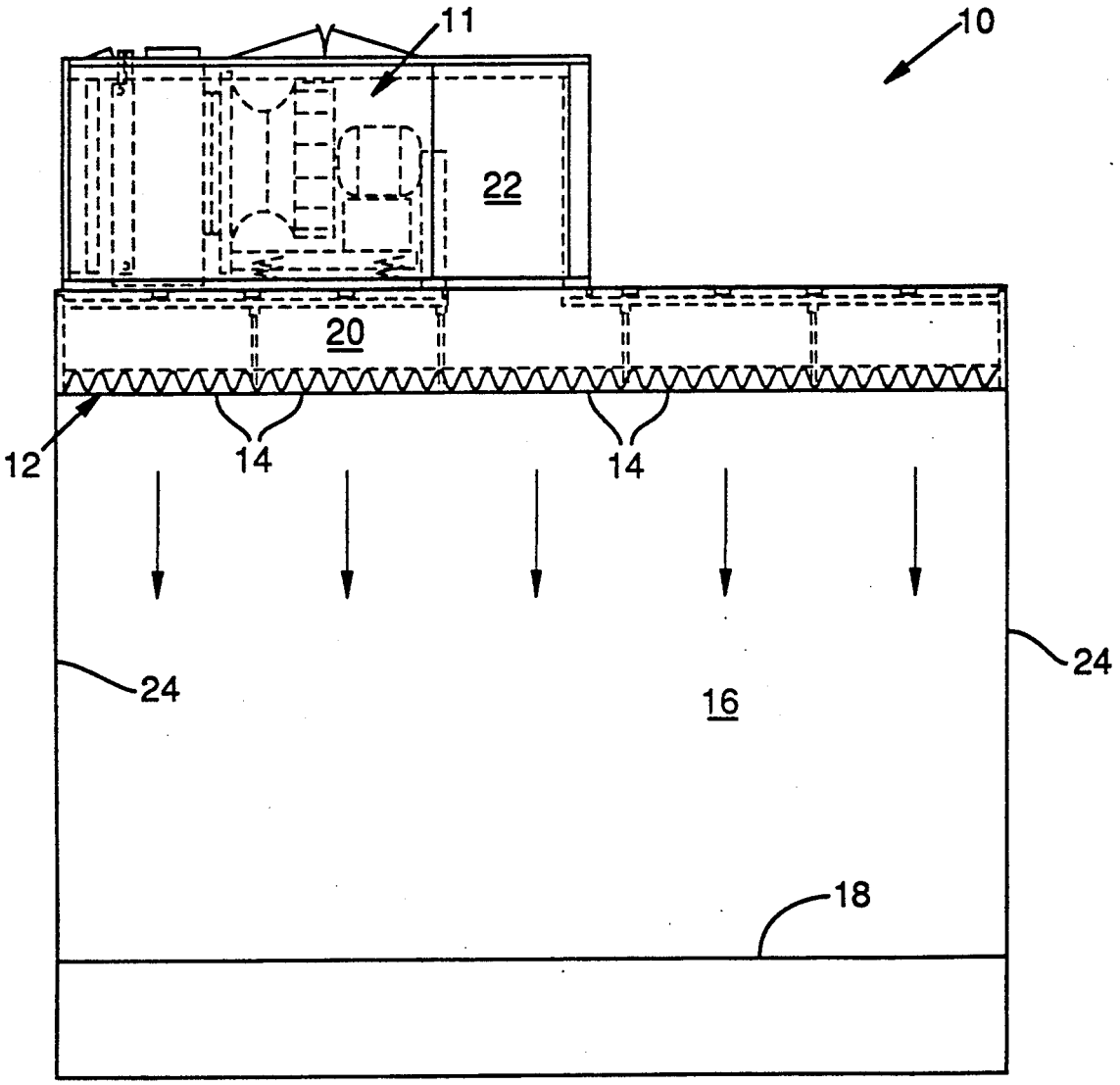
FIG. 1 is a sectional view of a clean room employing air balance dampers according to the present invention.
Figure 2:
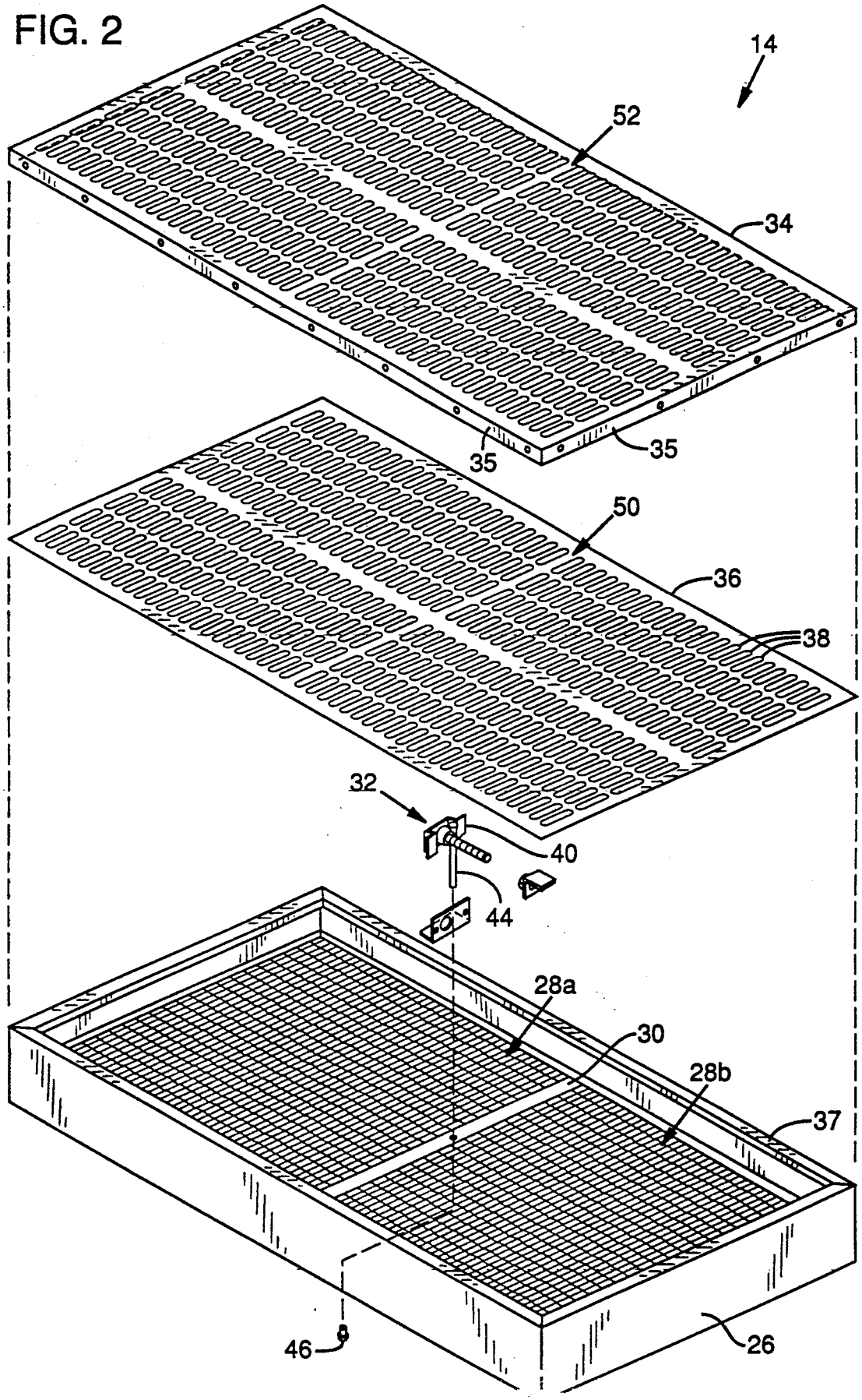
FIG. 2 is an exploded view of an air balance damper/filter assembly according to one embodiment of the present invention.
Figure 3:
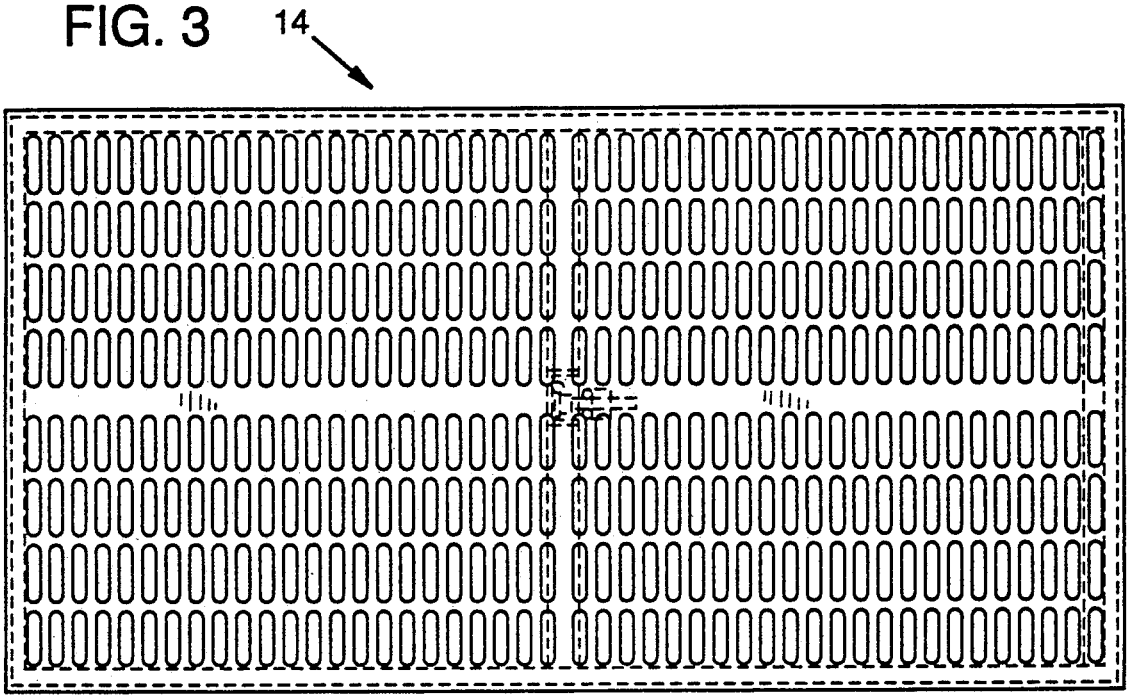
FIG. 3 is a top view of the damper of FIG. 2.
Figure 4:
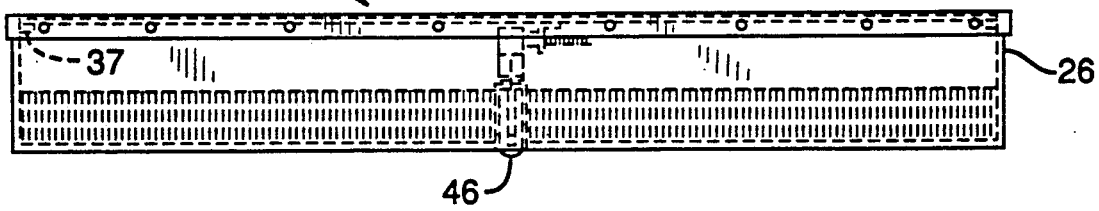
FIG. 4 is a side view of the damper of FIG. 2.
Figure 7:
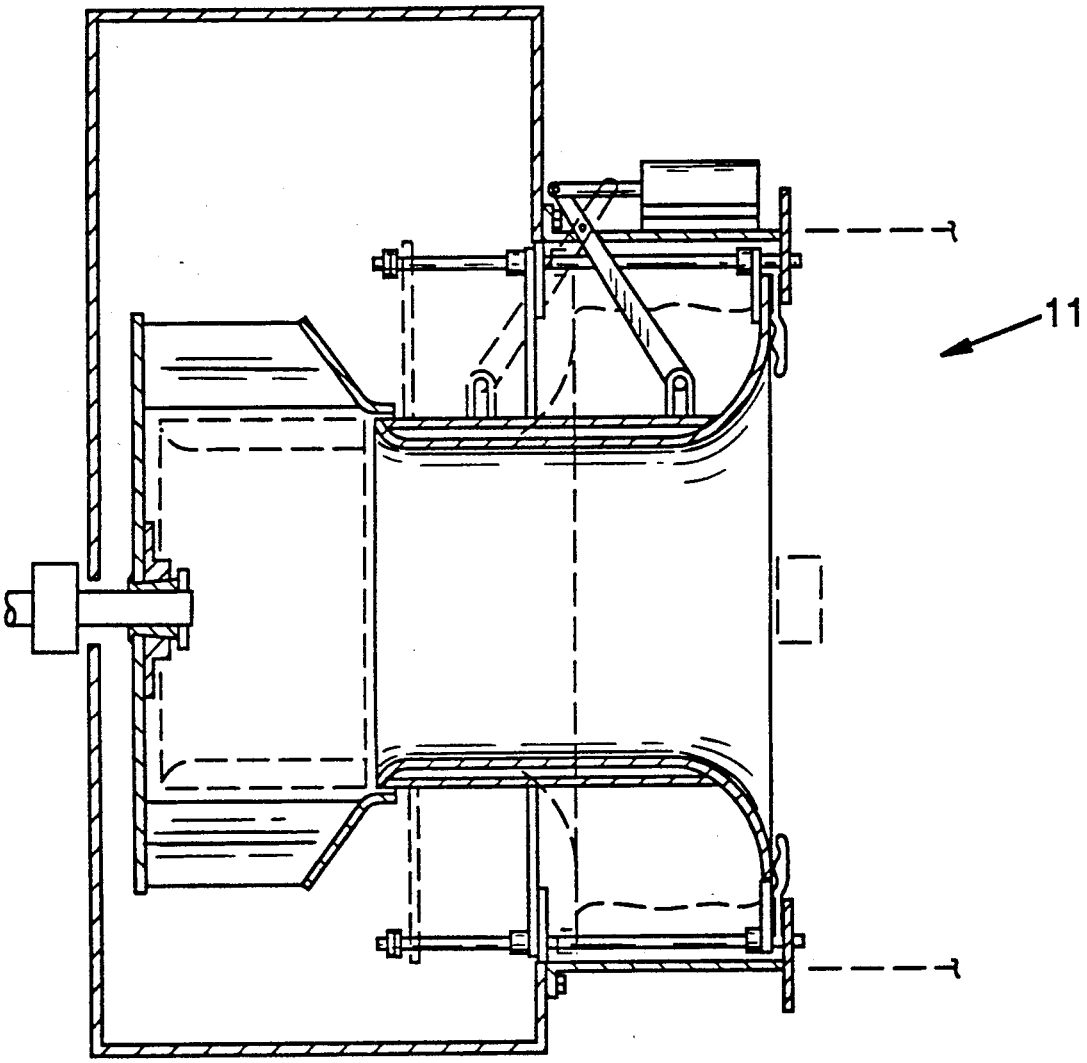
FIG. 7 is a view of a variable volume centrifugal blower that may be used in the present invention.

Referring to FIG. 1, an illustrative clean room 10 according to the present invention includes an air blower 11, a suspended ceiling 12 (comprised of a number of panels 14), a room 16 and a raised floor 18. The blower 11 (FIG. 7) is desirably one whose air flow can be remotely controlled, as illustrated in the above-referenced allowed application.

Above ceiling 12 is a plenum 20 through which air travels from the blower 11. It will be recognized that, if no equalization is provided, the air flow through the panels nearest the blower outlet 22 will be substantially higher than the air flow through the remote panels adjacent the walls 24 of the room.

The construction of panels 14 is illustrated in FIGS. 2–6. Basically, each panel comprises a frame 26 into which are mounted high efficiency particulate air filters **28*a* and 28*b***. In the illustrated embodiment, the frame dimensions are approximately 2 feet wide by 4 feet long by 6 inches high, although it will be recognized that other dimensions may of course be used.

Sealing the opening at the top of the frame is a first, stationary aluminum plate 34 which has flanges 35 extending downwardly therefrom that are attached to the upper outer periphery of the frame. Positioned immediately below this plate is a second, shorter aluminum plate 36 that is permitted to slide beneath the first on a lip 37 that extends about the top periphery of the frame. Both plates are perforated with a plurality of elongated slots 38. By sliding the second plate relative to the first, the openings therethrough can be selectively opened or occluded, thereby controlling the passage of air into the filter. The first plate 36 has unperforated margins 39 at the ends thereof so that openings at one end won't be unintentionally exposed when the second plate is slid towards the other end.

Included in frame 26 is a bracket 30 that bisects the lower portion of the frame and defines two regions into which the two filters **28*a*, 28*b* are received. Attached to bracket 26 is a control mechanism 32. This mechanism comprises a 90° worm drive gear assembly 40, best shown in FIGS. 5 and 6. A member 42 links this mechanism to the lower plate 36 and permits this plate to be controllably moved relative to the first. A drive shaft 44 extends downwardly from the worm drive through the bracket 30 and into a hollow 41 defined thereby. This hollow is closed on the lower surface of the panel 14 except for a hole through which the shaft 44 can be accessed and turned. This hole is normally plugged by a plug 46**.

Figure 5:
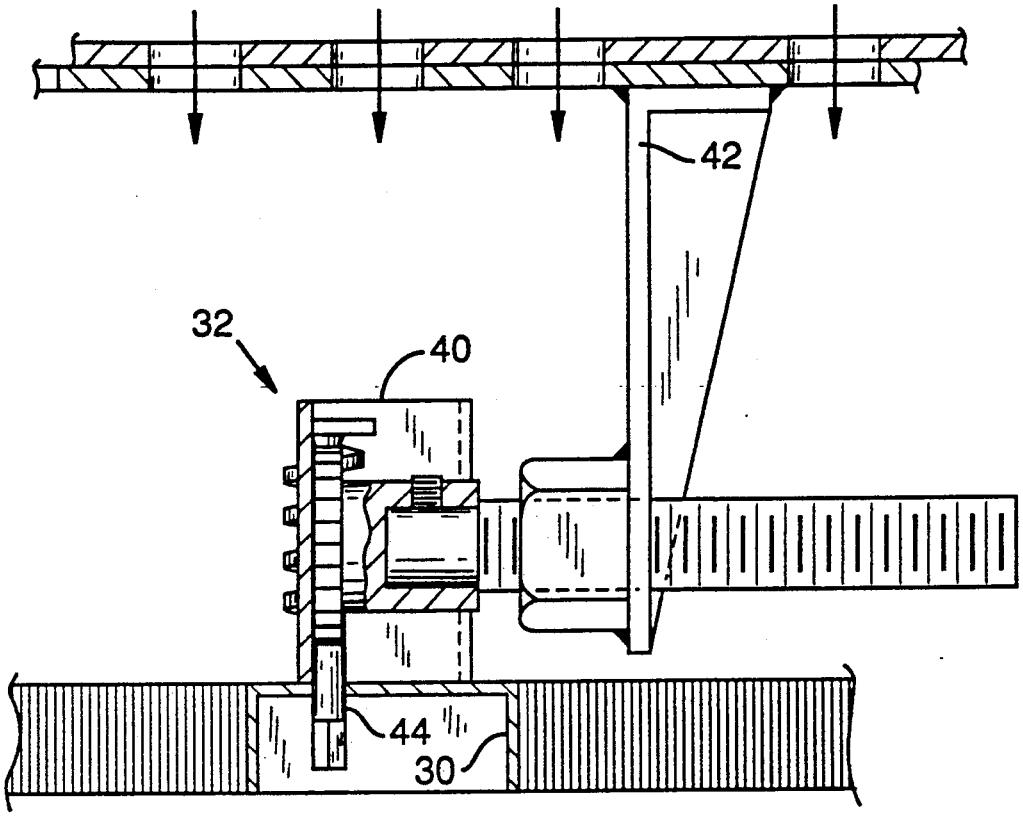
FIG. 5 is a fragmentary section view of the damper/filter assembly of FIG. 2 in the open position.
Figure 6:
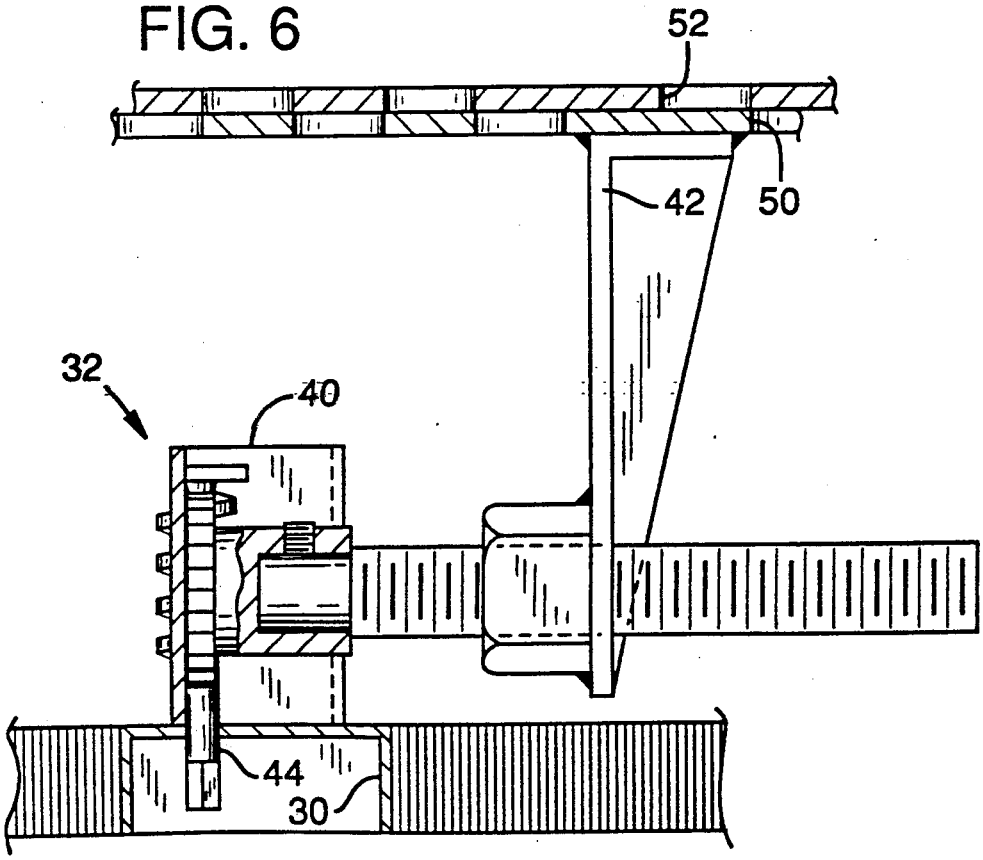
FIG. 6 is a fragmentary section view of the damper/filter assembly of FIG. 2 in the closed position.

In the preferred embodiment, plates 34 and 36 are not perforated in the middle regions 52, 50 thereof. This lack of perforations provides an uninterrupted bearing surface between the two plates where they are urged together by member 42 (thereby preventing any droop that might form a gap between the plates). This is illustrated in FIGS. 5 and 6, in which it can be seen that the central portion 50 of the second plate 36 to which member 42 attaches is in continuous engagement with the corresponding central portion 52 of the first plate 34, regardless of whether the damper is in its open or occluded position.

It will be recognized that the foregoing system advantageously permits control, by a single control, of all the air flow to the room, and further permits control, by a plurality of controls, of the air flow through each individual ceiling panel. The result is a flexible and efficient system that provides comprehensive control of a clean room's ventilation.

Having described and illustrated the principles of our invention with reference to a preferred embodiment thereof, it will be apparent that the invention can be modified in arrangement and detail without departing from such principles. Accordingly, we claim as our invention all such modifications as may come within the scope and spirit of the following claims and equivalents thereto.

We claim:

1. A ventilation system for a clean room comprising:

a centrifugal blower, said blower including a rotary bladed wheel having an axis of rotation, a baffle in the form of a surface of rotation concentrically disposed relative to said axis for permitting the volume of air moved by said blower to be controlled, and means permitting telescopic movement of the baffle relative to the wheel to vary the volume of air moved by said blower;

a plenum through which air can move from the blower to an area above the room;

a suspended ceiling separating the plenum and the room, said ceiling being comprised of a plurality of panels that each includes a particulate filter and an adjustable baffle for controlling the rate of air flow therethrough, the baffles being each individually controllable to establish a desired ratio between the air flows through the panels; and said baffle in the centrifugal blower being controllable independently of the baffles in the panels to permit a localized change in clean room air flow by controlling one or more of the panel baffles, and to permit a generalized change in clean room air flow by controlling the blower baffle.

2. In a ventilation system for a clean room, said system including an air filtration system having a frame, an air filter, and an air valve comprised of first and second perforated plates positioned adjacent one another and mounted for slidable movement therebetween, an improvement wherein said air filter is segregated into first and second sections received into a lower portion of said frame and separated by a central bracket to which is attached a worm drive assembly, said assembly including a member extending upwardly coupling to the second plate to control the position thereof, said assembly further including a shaft extending downwardly through the bracket into a hollow defined by said bracket, said hollow being sealed below but having an opening through which the shaft can be accessed and turned, said opening normally being plugged by a plug.

3. The invention of claim 2 in which the first and second plates each have a central region that is unperforated.

4. The invention of claim 2 in which the second perforated plate is mounted for slidable movement beneath the first.

5. A method for controlling the air flow in a clean room, the method comprising the steps:

blowing air from a blower into a plenum;

passing said air through air filter panels comprising the ceiling of the clean room; and controlling the rate of air flow to the room as a whole with a first control and controlling the rate of air flow through each of the individual ceiling panels with a plurality of second controls.

* * * * *